United States Patent [19]

Mahoney

[11] 4,138,029

[45] Feb. 6, 1979

[54] BAND TIGHTNESS INDICATOR

[75] Inventor: William P. Mahoney, Muncie, Ind.

[73] Assignee: Ball Corporation, Muncie, Ind.

[21] Appl. No.: 751,689

[22] Filed: Dec. 17, 1976

[51] Int. Cl.[2] ..... B65B 7/28

[52] U.S. Cl. ..... 215/230; 206/459; 215/276

[58] Field of Search ..... 215/230, 276; 206/534, 206/459; 116/124 R; 40/310, 311, 306, 307

[56] References Cited

U.S. PATENT DOCUMENTS

| | | | |
|---|---|---|---|
| 490,720 | 1/1893 | Ogram | 40/311 |
| 1,337,034 | 4/1920 | Bauermeister | 215/230 |
| 1,425,594 | 8/1922 | Keeran | 215/276 X |
| 2,135,834 | 11/1938 | Overmyer | 215/276 |
| 2,587,147 | 2/1952 | Guion et al. | 40/311 X |
| 2,939,597 | 6/1960 | Greene | 215/230 |
| 3,216,600 | 11/1965 | Dreps | 215/230 |
| 3,818,858 | 6/1974 | Kramer et al. | 215/230 X |

*Primary Examiner*—Daniel M. Yasich
*Attorney, Agent, or Firm*—Gilbert E. Alberding

[57] ABSTRACT

In home canning equipment in which a two-piece closure is threaded onto a jar mouth to provide a sealed container, the band and lid of the closure are provided with respective sets of indicia which, when brought into a preselected pattern of registry by helical rotation of the band relative to the lid, uniformly provides such sealed containers with a degree of sealing gasket compression that is closer to ideal.

10 Claims, 4 Drawing Figures

BAND TIGHTNESS INDICATOR

BACKGROUND OF THE INVENTION

Home canning equipment in widespread use includes glass jars, the finish portions of which are generally provided with four continuous external helical threads to the inch, with no thread stop to limit rotation of the closure. A typical closure comprises a two-piece assembly which includes a lid and a threaded band. The lid is a disk, typically made of sheet metal such as tin-free steel ("T.F.S."), or electrotin plate ("E.T.P."), concentrically provided on its underside with a shallow annular trough containing a sealing gasket united with the disk. After a lid is placed with its gasket in sealing relation to the end of the jar finish, a band is threaded in place to protect the sealing relationship. When the band is threadably tightened, beyond initial contact of its annular flange with the upper surface of the radially outer peripheral region of the lid, the gasket is progressively axially compressed in thickness to improve the effectiveness of the sealing relationship.

If a gasket is insufficiently compressed, the lowered degree of vacuum which can be maintained within the jar may reduce shelf life or permit spoilage of the canned food. On the other hand, if the band is threadably tightened to excess, too much of the gasket will be squeezed out from between the disk and the end of the finish and the risk of loss of the sealing relationship will increase. Between insufficiency and excess, there is a range of seal compression for which the risk of loss of the sealing relationship is minimized. That corresponds to an ideal degree of tightness for the band.

Instructions provided to home canners are typified by the 29th edition of the *Ball Blue Book*, which was available from Ball Corporation in mid-1976. It instructs the home canner to turn the bands until they are "firmly tight". When home canning skills are passed along by apprenticeship, the learned canner can demonstrate, observe and make sure the novice applies an acceptable degree of tightness to the band. It is a continuing goal to provide written and pictorial instructions which may be followed with ease and confidence to produce reliably canned foods even for an otherwise unaided and inexperienced person who desires to be a home canner.

A simple solution readily presents itself. A first tick mark may be placed on the side of the jar, and a second tick mark may be provided on the band, at such relative locations that the gasket is sufficiently compressed when the band is tightened just enough to align the tick marks.

However, variations both available and foreseeable in home canning equipment render the foregoing solution impractical, except for the special case wherein the user has available a supply of jars and closures that are designed for one another and remain in supply with uniform specifications over the years. Such a special case is an essential part of the proposal put forward in the prior U.S. Pat. No. 3,216,600 of Dreps.

In general, containers for home canning are subject to meeting many industry-accepted standards which tolerate interchanging of jars, lids, bands, and other closures, among brands and years of manufacture. This is a practical necessity, as it is a common expectation in home canning that jars will be used and reused several times over a period of years, but that closures, or some constituents of closures will not be reused, or will be more frequently replaced than jars. Although lids are almost never reused, bands are frequently reused, but rarely to the extent that jars are reused.

Those standards advantageously permit adoption of different materials and thicknesses for the lid gaskets. However, as a result, the amount of turning of closure bands needed to produce an acceptable compression of lid gaskets of different thickness or composition is not a single constant value in the home canning field.

SUMMARY OF THE INVENTION

In home canning equipment in which a two-piece closure is threaded onto a jar mouth to provide a sealed container, the band and lid of the closure are provided with respective sets of indicia which, when brought into a preselected pattern of registry by helical rotation of the band relative to the lid, uniformly provides such sealed containers with a degree of sealing gasket compression that is closer to ideal, move easily, without requiring use of unusual canning jars.

Because each different style of lid may have its own unique arrangement of its set of indicia to take into account its dimensions and constituency, a uniform act of producing registry may be called for by an instruction that will apply equally well for each style of lid.

In one disclosed embodiment, the set of indicia on the lid is provided in two series, displaced from the other by an odd integer times one half the inter-item angular spacing in each series. The consumer is instructed to use the band series which contains an item already angularly closest to an item in the lid series, thus halving the potential small error resulting from item spacing.

In a simple form, the invention calls for testing to predetermine what amount of gasket compression is sufficient but not excessive for a particular style of lid, determining the amount of band rotation corresponding to that amount of gasket compression, applying the lid to the jar, turning the band until it just touches the lid, observing the juxtaposition of a first indicium on the band relative to a second indicium on the lid, and turning the band in a tightening sense by said predetermined amount of band rotation. In practice, this latter step is facilitated by providing a third indicium, incorporated on the lid, and disposed angularly of the second indicium by an amount equating to said predetermined amount.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF PRESENTLY PREFERRED EMBODIMENTS

Figure 1:
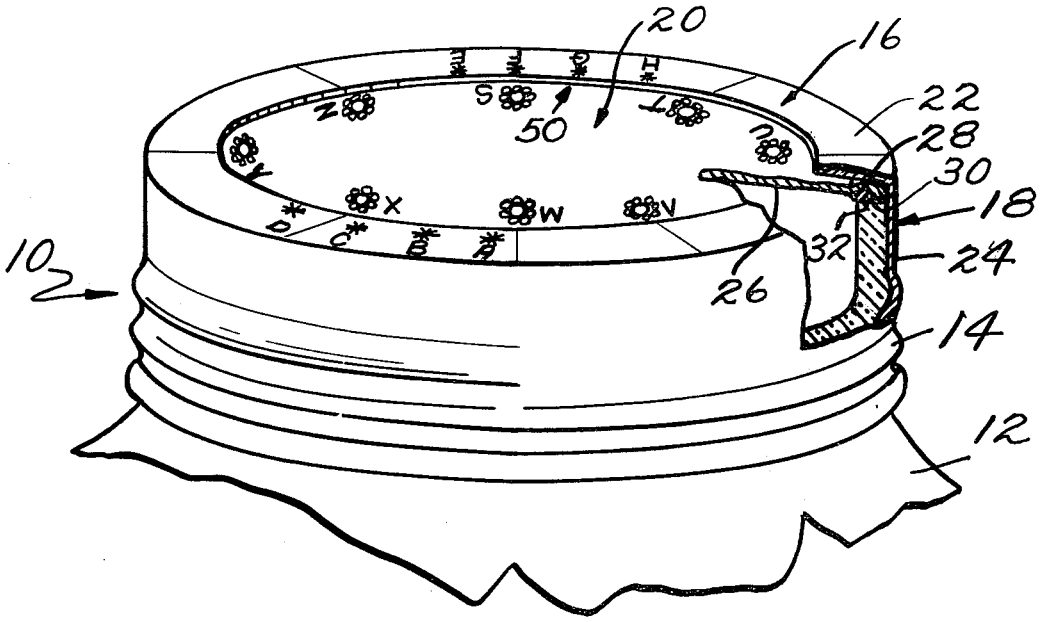
FIG. 1 is a fragmentary perspective view, partially in longitudinal section, of a canning jar with a two-piece, indicia-bearing closure assembled thereto and the band of the closure threadably applied until it has just touched the outer face of the lid.

In the figures, home canning equipment 10 is depicted, in which a sealed container is constituted by a jar with an exteriorly threaded finish 14 onto which is threadably applied a two-piece closure 16.

The closure 16 includes a band 18 and a lid 20.

The band 18 has an annular bezel 22 with a depending skirt 24 that is internally helically threaded for threaded assembly with the jar finish.

The lid 20 is a disk 26 with a coaxial annulus 28 of sealing gasket material applied on the outer peripheral portion of the underside of the disk, in this instance into a shallow trough 30.

Of course, canning methods differ in detail, but in a typical method food is placed in cleaned jars, lidded via rotating the band to compress the gasket material and subjecting the jars to heat, and often pressure, with bands 18 tightly in place. In effect the gasket 28 seals with the outer end 32 of the jar finish when the band 18 is threadably applied.

So far, the detailed description has described only features which the home canning equipment made and used according to the present invention shares in common with the present home canning equipment existing in commerce and in widespread use. Beyond the foregoing details, the closures of the present invention may have the same constituency, dimensions, conditions and usefulness of their utterly conventional counterparts.

However, due to physical differences developed for the purpose, home canning equipment incorporating use of bands and lids embodying the principles of the present invention may be given a degree of sealing gasket compression that is closer to ideal. Those physical differences and use will now be described in more detail.

Figure 3:
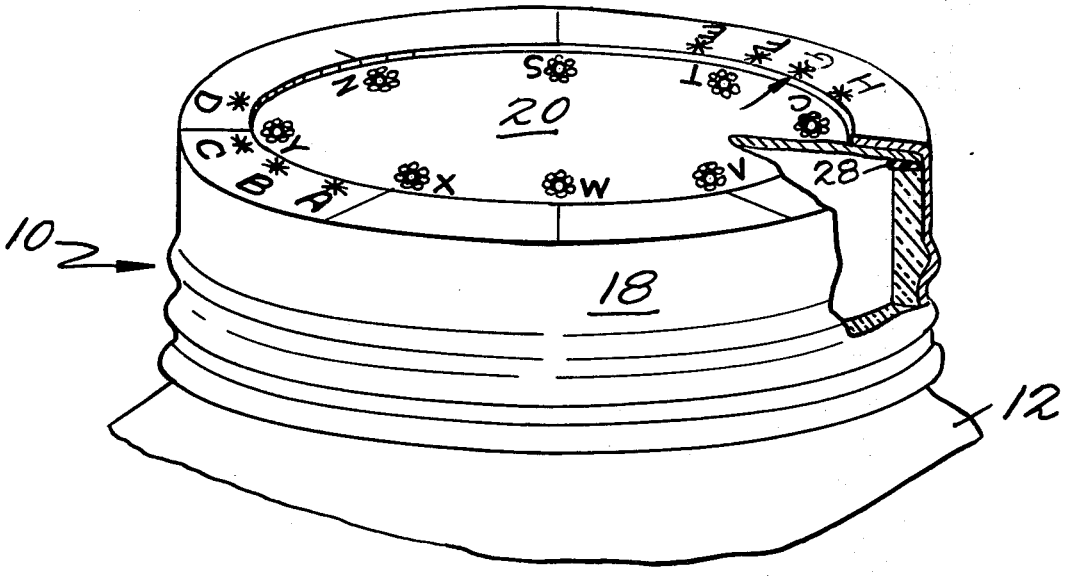
FIG. 3 is a hybrid fragmentary view thereof similar to FIG. 1, but showing the juxtaposition of the parts upon rotation of the band to sufficiently compress the gasket, following the principles of the present invention.
Figure 4:
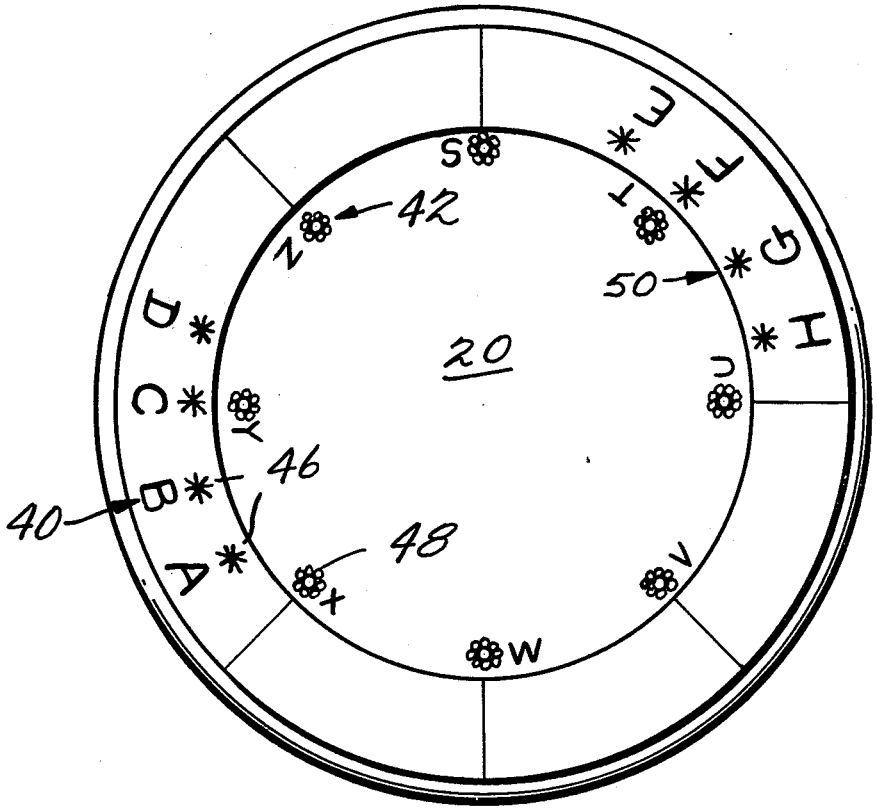
FIG. 4 is a top plan view thereof in the condition shown in FIG. 3.

The present inventor finds that providing the band and lid of the closure with respective sets of indicia (e.g. tangible landmarks) 40, 42 is a better way of controlling application tightness of two-piece closures for home canning jars, than an instruction to screw the band on until it is "firmly tight". It is also a better way than providing respective sets of indicia (e.g. tangible landmarks) on the band and jar. Ball Corporation manufactures some lids with gaskets of plastisol and others with gaskets of latex. In the future, other gasketing materials may be developed which require different degrees of band tightness to provide sufficient gasket compression. As one example, it has been determined that rotation of the band 40° to 45° from just touching (FIGS. 1 and 2) to the relative orientation shown in FIGS. 3 and 4 provides an axial compression of a conventional plastisol gasket material amounting to about 0.03125 inches, produced a torque on the band of about 25-inch pounds and did provide the sealed container with a vacuum holding power of about 15 in.Hg.

It is a relatively simple matter to test each style of lid, to predetermine the degree of band rotation needed to produce the ideal amount of gasket compression, and to provide lids of each style with a set of indicia 42 which takes that factor into account.

For example, assume that the band 18 is provided with an arcuate series of four equiangularly, equiradially spaced marks 46 about its periphery, and the plastisol gasketed lid 20 is provided with a circular series of equiangularly, equiradially spaced marks 48 near its outer edge (but spaced inwardly enough to avoid being fully obscured by the bezel of the band 18). In this example, series of marks 46 has an angular length equal to the angular distance between each two angularly adjacent items in the series of marks 48. It could extend completely around the band. The marks 46 and/or 48 may be as simple as dots or radiating dashes, or they may be incorporated into a decorative scheme. In the instance shown, the marks 46 are "stars" and the marks 48 are "flowers". A home canning consumer-oriented instruction for practicing the invention, using the home canning equipment shown in FIGS. 1–4 may read as follows:

1. Place the lid on the jar.
2. Tighten the band until it just touches the lid.
3. Locate the star nearest a flower and tighten the band until that star just passes the next flower.

Using such a system, the degree of error in achieving the degree of tightening equating to the pre-determined degree of ideal gasket compression will be, at most, half the angular distance between two stars. Thus, if as in this example the distance between two flowers is 45° and the series of marks 46 is constituted by four stars, spaced each 15° along a 45° arc, the maximum error is only 7.5° of band travel (about 4mm of angular movement for the standard-size band 18).

Figure 2:
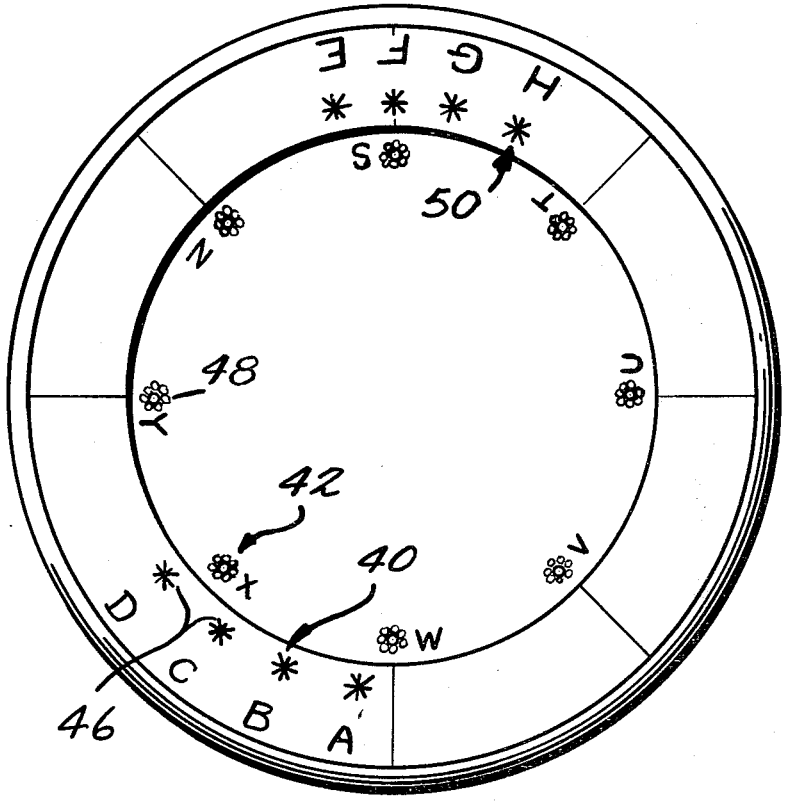
FIG. 2 is a top plan view thereof.

With reference to FIGS. 2 and 4, it should be noted that the maximum error may be reduced, e.g., halved, by providing a second series of marks 50, which is similar or identical to the series of marks 46, but displaced angularly by an odd integer multiple of half the angular distance between adjacent items in the series of items 46 on the band 18.

The corresponding instructions when using the home canning equipment shown in FIGS. 2 and 4 may read as follows:

1. Place the lid on the jar.
2. Tighten the band until it just touches the lid.
3. Locate the star in either set which is nearest a flower and tighten the band until that star just passes the next flower.

The marks in each series need not be alike, e.g., a series of different fruits and vegetables may aid the user in keeping track of the selected items. For instance, it may prove easier for a consumer to locate a unique vegetable in the series 46 or 50 that is nearest a unique fruit in the series 48. Thus, the home canner may find that any apple is nearest a green bean, and in fulfilling instruction step 3., rotate the band 18 until that apple passes the carrot that is next in series to the green bean. Likewise, the marks may differ in color, size or in any tangible characteristic.

Should the further development of gasketing materials cause a need for a different degree of tightness, this will neither affect the instructions for the home canner, nor render the bands 18 obsolete. Rather, the respective new lids may be provided with a series of marks 48 that have closer or further spacing between series items. When used according to the same instructions, with the same bands 18, following the instructions will automatically provide the new requisite degree of application firmness, i.e., band tightness for ideal use of the new lids.

It should now be apparent that the band tightness indicator, as described hereinabove, possesses each of the attributes set forth in the specification under the heading "Summary of the Invention" hereinbefore. Because the band tightness indicator can be modified to some extent without departing from the principles of the invention as they have been outlined and explained in this specification, the present invention should be understood as encompassing all such modifications as are within the spirit and scope of the following claims.

What is claimed is:

1. A closure for the opening in a container provided with a threaded portion, which closure comprises:

a top apertured, bezeled, threaded band;

a disk disposed under the apertured top of the band and having sealingly provided on one side thereof a predetermined compressible sealing material requiring a corresponding predetermined degree of compression against the container opening to effect a desired sealing relationship therebetween and having on the other side of said disk at least two indicia spaced apart angularly of the disk by an amount substantially equal to a predetermined amount through which the closure band must be further threadably turned once its bezel just touches the disk to effect said desired sealing relationship between the compressible sealing material and the container opening;

a first one of said indicia cooperating with said band by identifying a specific selected portion thereof opposite said first indicia once the bezel just touches the disk and a second one of said indicia indicating said desired sealing relationship when further turned to be situated opposite said specific selected portion of the band.

2. The closure of claim 1 wherein said closure band includes at least one indicium thereon for denoting said specific selected portion as it comes into successive juxtaposition with individuals of said indicia of disk as said band is turned.

3. A closure lid for use with a top apertured, bezeled, threaded closure band to seal a container opening having a threaded finish, said closure lid comprising:

a disk adapted to be disposed under the apertured top of the band and having a predetermined sealing gasket material applied on the underside thereof requiring a corresponding predetermined degree of compression against the container opening to effect a desired sealing relationship therebetween and having applied on the upper side of said disk at least two indicia spaced apart angularly of the lid by an amount which is substantially equal to a predetermined amount through which the band must be further turned angularly, once its bezel just touches the lid, to effect said desired sealing relationship by sufficiently but not excessively axially compressing the sealing gasket material between the disk and the container opening;

a first one of said indicia cooperating with said band by identifying a specific selected portion thereof opposite said first indicia once the bezel just touches the disk and a second one of said indicia indicating said desired sealing relationship when situated opposite said specific selected portion of the band.

4. The closure lid of claim 3 further including said band and at least one indicium on said band for denoting said specific selected portion as it comes into successive juxtaposition with individuals of said indicia of disk as said band is turned.

5. A home canning closure lid for use with a top apertured threaded home canning closure band to close and seal a home canning jar having a threaded finish, said home canning closure lid comprising:

a disk adapted to be disposed under the apertured top of the band and having a ring of predetermined plastic sealing gasket material applied on the underside thereof requiring a corresponding predetermined degree of compression against the container to effect a desired sealing relationship therebetween and having applied on the upper side of said disk a series of at least two tangible marks spaced apart angularly of the lid by a predetermined amount which is substantially equal to the amount by which the band must be further turned angularly, once it just touches the lid, to effect said desired sealing relationship by sufficiently but not excessively axially compress the ring of sealing gasket material between the disk and the jar finish;

a first one of said marks cooperating with said band by identifying a specific portion thereof opposite said first mark once the band just touches the lid and a second one of said marks indicating said desired sealing relationship when situated opposite said specific portion of the band.

6. The home canning closure lid of claim 5, further including:

a second series of at least two tangible marks applied on the upper side of the disk, the marks in the second series being angularly spaced from the marks in the first-described series by an odd integer multiple of half the angular spacing between angularly adjacent marks in the first-described series.

7. A two-piece closure for closing and sealing a home canning jar having a threaded finish, comprising:

a top apertured threaded home canning closure band, and a home canning closure lid, said lid comprising:

a disk adapted to be disposed under the apertured top of the band and having a ring of predetermined plastic sealing gasket material applied on the underside thereof requiring a corresponding predetermined degree of compression against the container opening to effect a desired sealing relationship therebetween and having applied on the upperside of said disk a series of at least two tangible marks spaced apart angularly of the lid by a predetermined amount which is substantially equal to the amount by which the band must be further turned angularly, once it just touches the lid, to effect said desired sealing relationship by sufficiently but not excessively axially compressing the ring of sealing gasket material between the disk and the jar finish;

a first one of said marks cooperating with said band by identifying a specific portion thereof opposite said first mark once the band just touches the lid and a second one of said marks indicating said desired sealing relationship when situated opposite said specific portion of the band.

8. The two-piece closure of claim 7, wherein the band includes at least one tangible mark so disposed on the band as to be in radial juxtaposition with one of said at least two tangible marks on the lid when the band has been screwed onto the jar finish until the band just touches the lid, and to be in radial juxtaposition with an angularly adjacent next one of said at least two tangible marks on the lid when the band has been further turned by the respective said amount.

9. In the field of home canning equipment wherein a sealed container is constituted by assembly of (a) a jar having a threaded finish with an end, (b) a lid with an annular gasket of predetermined plastic sealing material disposed on the underside of the lid for sealing engagement with the jar finish end under a corresponding predetermined degree of compression thereagainst, and (c) a top apertured threaded tubular band with an annular bezel flange for engaging the upper side of the lid when the band is threaded onto the jar finish, a method by which suppliers of closure parts can facilitate the provision by home canners of a predetermined sufficient but not excessive sealing gasket compression when assembling the sealed containers, comprising:

(i) determining for a specific design of lid/gasket a predetermined range of gasket axial compression that is sufficient to provide the container with adequate vacuum holding power yet not so excessive as to squeeze so much of the gasket from between the lid and the jar finish end as to risk leakage;

(ii) translating said range of axial compression into a predetermined amount of further arcuate turning of the band in a sense to thread the band further onto the jar finish once a lid/gasket of that specific design is in place, from the point where the bezel flange just engages the lid, for producing said predetermined amount of gasket axial compression within said predetermined range; and (iii) providing a series of at least two tangible marks on the outer side of the lid, these marks being spaced from one another angularly of the lid by said predetermined amount whereby the home canner may select a specific portion or landmark on the band in radial juxtaposition with one of said tangible marks when the bezel flange just engages the lid and then rotate the band further until that selected landmark is brought to radial juxtaposition with an angularly next one of said tangible marks, to provide said predetermined amount of sealing gasket axial compression.

10. In the field of home canning equipment wherein a sealed container is constituted by assembly of (a) a jar having a threaded finish with an end, (b) a lid with an annular gasket of predetermined plastic sealing material disposed on the underside of the lid for sealing engagement with the jar finish end under a corresponding predetermined degree of compression thereagainst, and (c) a top apertured threaded tubular band with an annular bezel flange for engaging the upper side of the lid when the band is threaded onto the jar finish, and there is provided on the outer side of the lid a series of at least two tangible marks which are spaced from one another angularly of the lid by a predetermined amount equal to the amount of further arcuate turning of the band needed to provide said predetermined degree of compression which is a sufficient but not excessive amount of gasket axial compression, from when the bezel flange just engages the lid, a method for instructing a home canner to provide said predetermined amount of gasket axial compression when assembling the sealed container, comprising instructing the home canner to:

(i) place the lid on the jar, (ii) tighten the band until the bezel flange just engages the lid, (iii) locate a specific selected portion or landmark on the band in radial juxtaposition with one of said tangible marks, and (iv) rotate the band further until that specific located or selected portion or landmark is brought to radial juxtaposition with an angularly next one of said tangible marks.

* * * * *